US006591717B2

(12) United States Patent
Wei

(10) Patent No.: US 6,591,717 B2
(45) Date of Patent: Jul. 15, 2003

(54) PLUM BLOSSOM-SHAPED RATCHET WRENCH STRUCTURE

(76) Inventor: Hung Yin Wei, No. 2, Lane 235, Yung-Yi Rd., Tai-Ping City, Taichung Hsien (TW)

( * ) Notice: Subject to any disclaimer, the term of this patent is extended or adjusted under 35 U.S.C. 154(b) by 0 days.

(21) Appl. No.: 10/068,897

(22) Filed: Feb. 11, 2002

(65) Prior Publication Data

US 2002/0096021 A1 Jul. 25, 2002

Related U.S. Application Data

(63) Continuation-in-part of application No. 09/765,573, filed on Jan. 22, 2001, now abandoned.

(51) Int. Cl.[7] ..... B25B 13/46
(52) U.S. Cl. ..... 81/60
(58) Field of Search ..... 81/60–63.2

(56) References Cited

U.S. PATENT DOCUMENTS 28,964 A * 7/1860 Buttles ..... 81/61
1,179,341 A * 4/1916 Spirikowicz ..... 81/63
2,317,461 A * 4/1943 Jackson ..... 81/60
3,349,653 A * 10/1967 Kaufman et al. ..... 81/60
3,838,614 A * 10/1974 O'Donnell ..... 81/60
5,284,072 A * 2/1994 Smith ..... 81/63
6,205,889 B1 * 3/2001 Hsieh ..... 81/60

* cited by examiner

*Primary Examiner*—D. S. Meislin
(74) *Attorney, Agent, or Firm*—Rosenberg, Klein & Lee

(57) ABSTRACT

A plum blossom-shaped ratchet wrench structure. A one-way ratchet is disposed in a head section of the grip of the ratchet wrench. A distance exists between a central point of the head section and a central line of the grip, whereby the head section has a protruding section laterally deflecting and protruding from one of the grip for a user to easily identify the driving direction of the one-way ratchet. A widened connecting section is formed between the protruding section and the lateral side of the grip. A receptacle is formed in the connecting section, in which a ratchet block is disposed. The receptacle has an opening having a length smaller than a length of the ratchet block, while being larger than a height of the ratchet block. When the ratchet block is installed into the receptacle, the ratchet block is stopped by the wall of the receptacle.

3 Claims, 6 Drawing Sheets

PLUM BLOSSOM-SHAPED RATCHET WRENCH STRUCTURE

CROSS-REFERENCE TO RELATED APPLICATION

This application is a Continuation-In-Part application of Ser. No. 09/765,573, filed Jan. 22, 2001, now abandoned, and entitled "PLUM BLOSSOM-SHAPED RATCHET WRENCH STRUCTURE."

BACKGROUND OF THE INVENTION

The present invention is related to an improved plum blossom-shaped ratchet wrench structure, and more particularly to a blossom-shaped ratchet wrench which is such configured that a user can very easily judge the driving direction of the one-way ratchet mechanism. Moreover, a widened ratchet block can be disposed in the ratchet wrench to enable the ratchet mechanism to bear greater torque.

FIG. 6 shows a conventional plum blossom-shaped one-way ratchet wrench 8 having a grip 81 and a head section 82. The head section 82 has a ratchet cavity 84 in which a one-way ratchet mechanism 9 is disposed. The center of the head section 82 is in the central line of the grip 81. The grip 81 has a receptacle 83 in which a ratchet block 91 and a spring 92 of the ratchet mechanism 9 are disposed.

Such conventional plum blossom-shaped one-way ratchet wrench 8 can only one-way drive the ratchet mechanism 9. Therefore, in general, the grip 81 or the head section 82 is marked with an arrow to indicate the driving direction. However, in a dark place, a user will be unable to clearly see the arrow and know the driving direction of the ratchet mechanism 9. This causes inconvenient to the user.

Moreover, the size of the ratchet block 91 of the ratchet mechanism 9 is limited to the width of the receptacle 83, while the dimension of the receptacle 83 is limited to the width of the grip 81. Therefore, the ratchet block 91 can be hardly enlarged as necessary so that the ratchet block 91 cannot bear greater torque. In the case that the width of the receptacle 83 is increased, the strength of the grip 81 will be affected.

The width of the opening of the receptacle 83 is larger than the width of the ratchet block 91. Therefore, when assembled, the ratchet block 91 will be resiliently pushed out by the spring 92. Therefore, it is necessary to use a tool to press the ratchet block 91 and compress the spring 92 for keeping the ratchet block 91 in the receptacle 83. Under such circumstance, the ratchet wheel 93 can be installed into the ratchet cavity 84. However, the opening of the receptacle 83 is positioned in the ratchet cavity 84. Therefore, the tool must be extended into the ratchet cavity 84 to press the ratchet block 91. At the same time, the ratchet wheel 93 is installed into the ratchet cavity 84. It is quite inconvenient to install the ratchet wheel 93. It often takes place that the ratchet block 91 is resiliently pushed out by the spring 92 due to incaution and needs to be re-installed. As a result, the assembling efficiency is lowered.

SUMMARY OF THE INVENTION

It is therefore a primary object of the present invention to provide an improved plum blossom-shaped ratchet wrench structure. A ratchet mechanism is disposed in a head section of the grip of the wrench. A distance exists between a central point of the head section and a central line of the grip. Therefore, the head section laterally deflects and protrudes from a lateral side of the grip to form a protruding section.

The protruding section serves as an indicator enabling a user to easily judge the driving direction of the one-way ratchet mechanism. Furthermore, a widened connecting section is formed between the protruding section of the head section and the grip so that the receptacle for the ratchet block can be widened. Therefore, a widened ratchet block of the ratchet mechanism can be disposed in the ratchet wrench, whereby the engaging face of the ratchet block and the ratchet can be enlarged and the number of engaging teeth thereof can be increased. As a result, the ratchet mechanism can bear greater torque.

It is a further object of the present invention to provide the above plum blossom-shaped ratchet wrench structure in which the length of the opening of the receptacle is smaller than the length of the ratchet block, while being larger than the height of the ratchet block. After the ratchet block is installed into the receptacle, the ratchet block is stopped by the wall of the receptacle without being resiliently pushed out by the resilient member. Accordingly, the assembling efficiency can be increased.

It is still a further object of the present invention to provide the above plum blossom-shaped ratchet wrench structure in which the bottom face of the ratchet block is a protruding arch face. When the ratchet wheel is engaged with the ratchet block, one end of the ratchet block is lifted to increase the engaging force between the ratchet wheel and the ratchet block. Therefore, the ratchet mechanism can be bear increased torque.

The present invention can be best understood through the following description and accompanying drawings wherein:

DETAILED DESCRIPTION OF THE PREFERRED EMBODIMENTS

Figure 1:
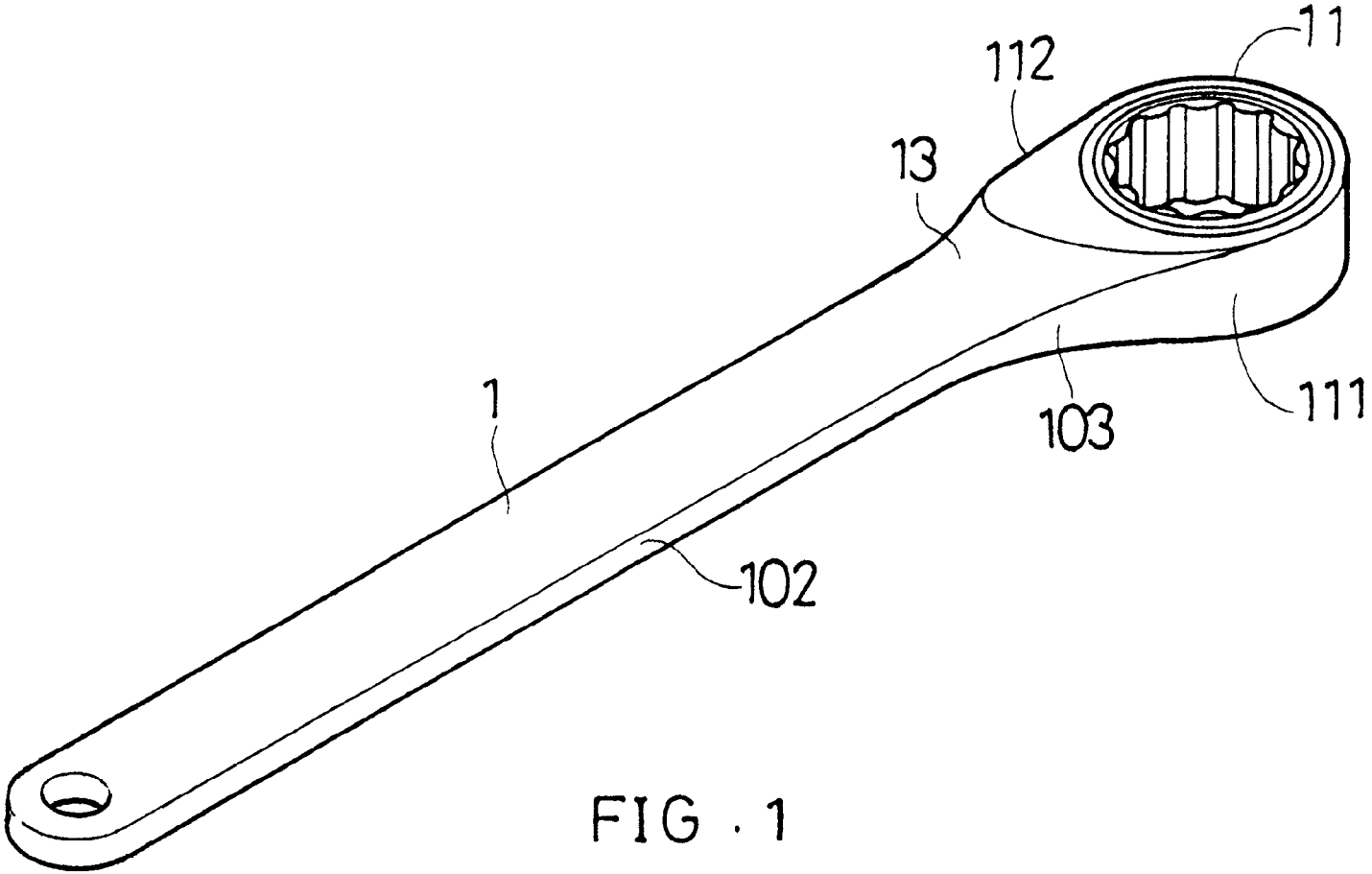
FIG. 1 is a perspective view of the ratchet wrench of the present invention.
Figure 2:
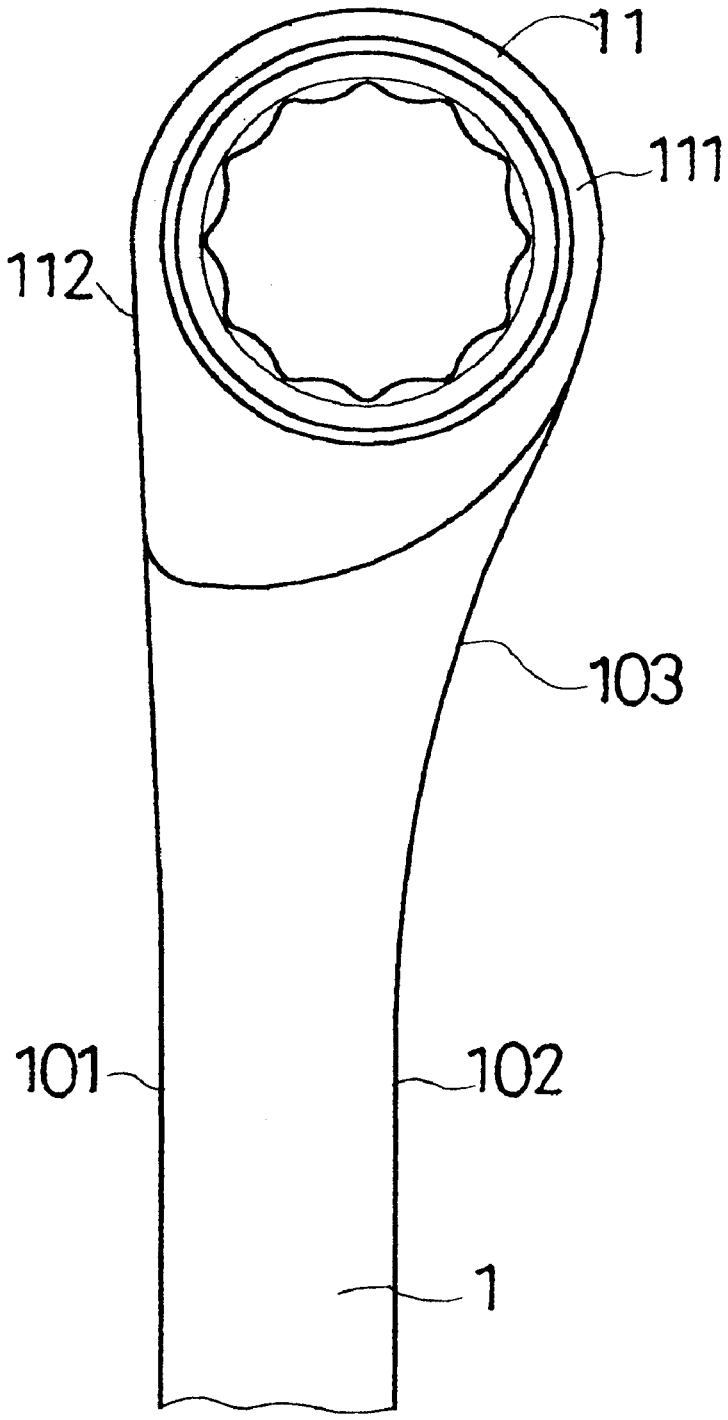
FIG. 2 is a plane view of the ratchet wrench of the present invention.
Figure 3:
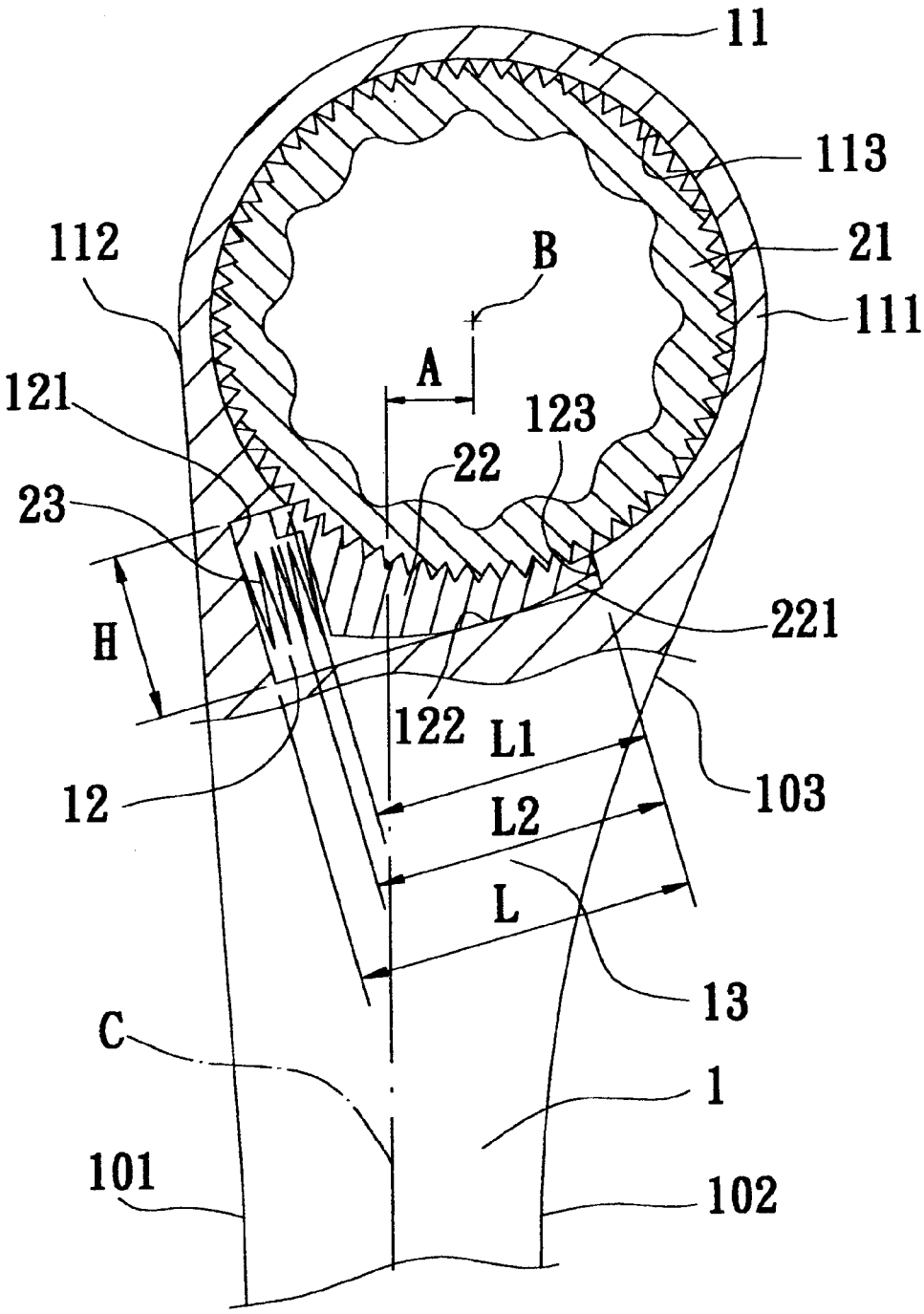
FIG. 3 is a sectional view showing the relationship between the grip, the head section and the receptacle of the ratchet wrench of the present invention.

Please refer to FIGS. 1 to 3. The plum blossom-shaped ratchet wrench structure of the present invention includes a grip 1 having a first side 101 and a second side 102. The grip 1 has a head section 11. A distance A exists between a central point B of the head section 11 and the central line C of the grip 1. Therefore, the head section 11 has a protruding section 111 which laterally deflects and protrudes from the second side 102 of the grip 1. A substantially straight section 112 is formed between the head section 11 and the first side 101. A wider connecting section 13 is formed between the protruding section 111 of the head section 11 and the second side 102.

The head section 11 is formed with a cavity 113 in which a ratchet 21 is disposed. A receptacle 12 is formed in the connecting section 13 of the grip 1 for receiving therein a ratchet block 22. The bottom face 221 of the ratchet block 22 is a protruding arch face. The receptacle 12 has an opening 123 communicating with the cavity 113. The length L1 of the opening 123 is smaller than the length L2 of the ratchet block 22, while being larger than the height H of the ratchet block 22. The receptacle 12 has a lateral face 121 and a bottom face 122 normal to the lateral face 121. The lateral face 121 is formed on one side of the receptacle 12 adjacent to the first side 101 of the grip 1. The bottom face 221 of the ratchet block 22 is slidably leant on the bottom face 122. A spring 23 is disposed between the lateral face 121 and the ratchet block 22. In normal state, the spring 23 resiliently pushes the ratchet block 22 to engage with the ratchet 21.

A distance A exists between the central point B of the head section 11 and the central line C of the grip 1, whereby a straight section 112 and a protruding section 111 are respectively formed between the head section 11 and the first and second sides 101, 102 of the grip 1. Therefore, in both visual perception and touch perception, a user can very easily distinguish the straight section 112 from the protruding section 111. The protruding direction of the protruding section 111 is right the direction in which the ratchet block 22 is pushed by the spring 23 to engage with the ratchet 21. That is, when the grip 1 is clockwise wrenched to the side of the straight section 112 as shown in FIG. 2, the ratchet block 22 will engage with the ratchet 21 to drive the ratchet 21 to rotate. Accordingly, the user can know the driving direction of the ratchet 21 only by means of getting a sight of the wrench. Even in a dark place, the user can still easily know the driving direction of the ratchet 21 by touch. Therefore, for those rescuers helping people in disasters such as earthquake, typhoon, flood, etc., the wrench can be more efficiently used.

The length L1 of the opening 123 of the receptacle 12 is smaller than the length L2 of the ratchet block 22, while being larger than the height H of the ratchet block 22. Therefore, when the ratchet block 22 is installed into the receptacle 12, the ratchet block 22 is stopped by the wall of the receptacle 12 without being resiliently pushed by the spring 23 of the receptacle 12. Accordingly, the ratchet block 22 can be more conveniently installed at higher efficiency.

Referring to FIG. 3, the protruding section 111 of the head section 11 laterally protrudes from the second side 102 of the grip 1 so that a widened connecting section 13 is formed between the protruding section 111 and the second side 102 of the grip 1. Accordingly, the length L of the receptacle 12 formed in the connecting section 13 can be increased. That is, the length L2 of the ratchet block 22 can be enlarged. Therefore, the engaging face of the ratchet block 22 and the ratchet 21 can be enlarged and the number of engaging teeth thereof can be increased. As a result, the ratchet 21 can bear greater torque.

Figure 4:
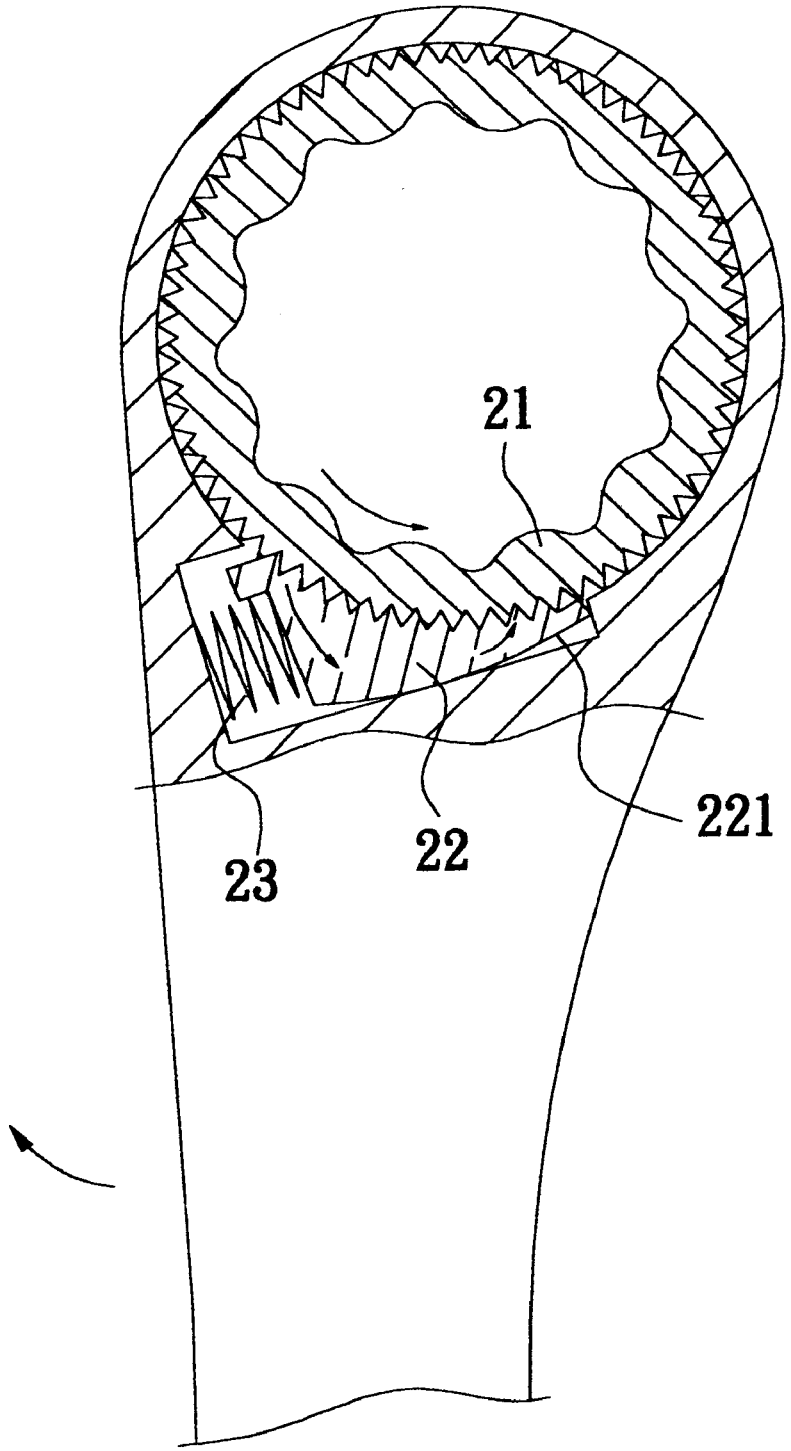
FIG. 4 shows that in use, the ratchet wheel of the present invention drives the ratchet block to move.

Moreover, the bottom face 221 of the ratchet block 22 is a protruding arch face. When a user clockwise wrenches the grip 1 as shown in FIG. 4, the ratchet 21 is engaged with the ratchet block 22 and one side of the ratchet block 22 adjacent to the spring 23 is depressed. The other end of the ratchet block 22 is lifted to enlarge the engaging force between the ratchet block 22 and the ratchet 21. Accordingly, the ratchet mechanism is able to bear greater torque.

In conclusion, the head section 11 is laterally deflected from the second side 102 of the grip 1 to form a protruding section 111, a straight section 112 and a widened connecting section 13 between the head section 11 and the grip 1. In both visual perception and touch perception, a user can very easily distinguish the straight section 112 from the protruding section 111 so as to easily know the driving direction of the ratchet 21.

Figure 5:
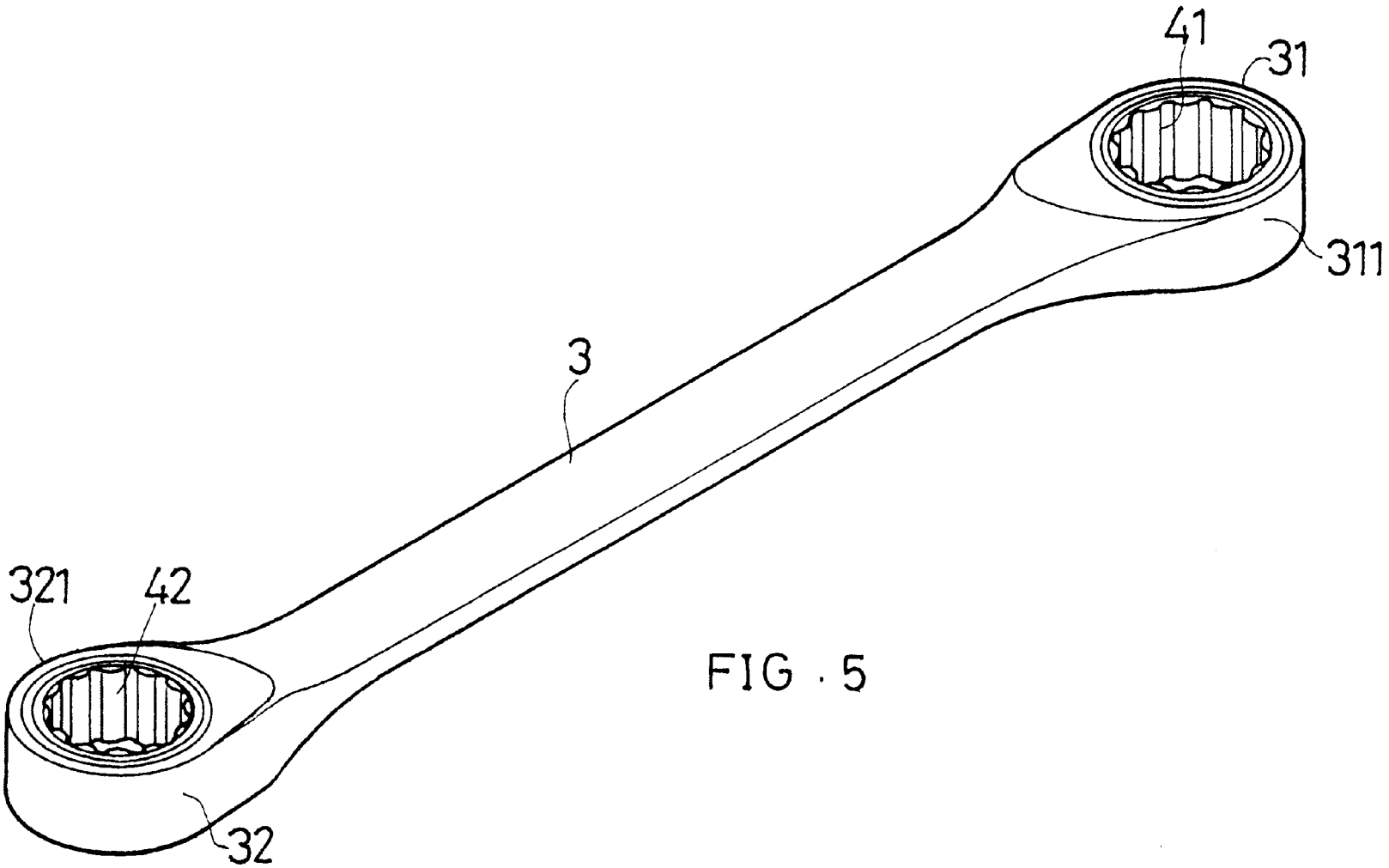
FIG. 5 is a perspective view of a second embodiment of the ratchet wrench of the present invention.
Figure 6:
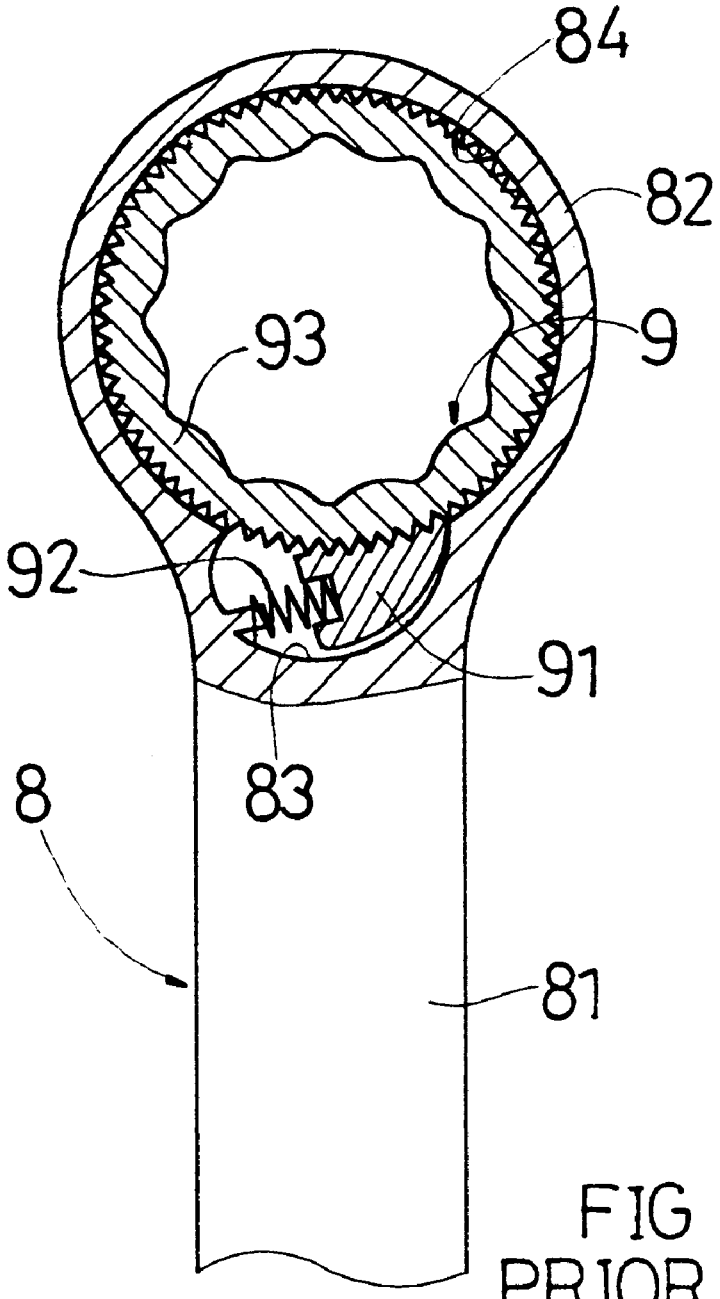
FIG. 6 PRIOR ART
FIG. 6 is a sectional view of a conventional plum blossom-shaped one-way ratchet wrench.

FIG. 5 shows a second embodiment of the present invention, in which two ends of the grip 3 are respectively formed with two head sections 31, 32 having different sizes for mounting different sizes of ratchets 41, 42 therein. The protruding sections 311, 321 of the two head sections 31, 32 are respectively positioned on different sides. The second embodiment can achieve the same function as the first embodiment.

The above embodiments are only used to illustrate the present invention, not intended to limit the scope thereof. Many modifications of the above embodiments can be made without departing from the spirit of the present invention.

What is claimed is:

1. A plum blossom-shaped ratchet wrench structure comprising a grip, the grip having a first side and a second side, at least one end of the grip being formed with a head section having a cavity in which a ratchet is disposed, a receptacle being formed between the grip and the head section for receiving therein a ratchet block, the receptacle having a lateral face and a bottom face normal to the lateral face, the lateral face being formed on one side of the receptacle adjacent to the first side of the grip, the ratchet block being slidably leant on the bottom face of the receptacle, a resilient member being disposed between the lateral face and the ratchet block, whereby in normal state, the resilient member resiliently pushes the ratchet block to engage with the ratchet, said ratchet wrench being characterized in that a distance exists between a central point of the head section and a central line of the grip, whereby the head section has a protruding section laterally deflecting and protruding from the second side of the grip, the bottom face of the ratchet block being a protruding arch face, the receptacle having an opening communicating with the cavity, the opening having a length smaller than a length of the ratchet block, while being larger than a height of the ratchet block.

2. The plum blossom-shaped ratchet wrench structure as claimed in claim 1, wherein a widened connecting section is formed between the protruding section of the head section and the grip, the receptacle being formed in the connecting section.

3. The plum blossom-shaped ratchet wrench structure as claimed in claim 1, wherein two ends of the grip are respectively formed with two head sections having different sizes, the protruding sections of the two head sections being respectively positioned on different sides.

* * * * *